United States Patent [19]

Desmond et al.

[11] Patent Number: 4,667,872

[45] **Date of Patent: * May 26, 1987**

[54] ICE CREAM CARTON

[75] Inventors: John D. Desmond, Philadelphia, Pa.; William H. Carr, Jr., Ashland, Ohio

[73] Assignee: Container Corp. of America, Chicago, Ill.

[ * ] Notice: The portion of the term of this patent subsequent to Dec. 10, 2002 has been disclaimed.

[21] Appl. No.: 813,403

[22] Filed: Dec. 26, 1985

Related U.S. Application Data

[63] Continuation-in-part of Ser. No. 696,391, Jan. 30, 1985, Pat. No. 4,557,415.

[51] Int. Cl.[4] ..... B65D 5/20

[52] U.S. Cl. ..... 229/106; 229/108

[58] Field of Search ..... 229/106, 108

[56] References Cited

U.S. PATENT DOCUMENTS 4,046,310 9/1977 Gustafsson ..... 229/30

4,049,188 9/1977 Persson ..... 220/418

FOREIGN PATENT DOCUMENTS 501259 1/1954 Italy ..... 229/32

27893 of 1913 United Kingdom ..... 229/32

*Primary Examiner*—Joseph Man-Fu Moy

*Attorney, Agent, or Firm*—Richard W. Carpenter

[57] ABSTRACT

An open top liquid-tight, carton having a flat bottom wall and flat side and end walls joined to each other by rounded corners, the carton being formed from a unitary blank of foldable sheet material such as coated paperboard.

5 Claims, 14 Drawing Figures

ICE CREAM CARTON

This application is a Continuation-in-Part of co-pending application Ser. No. 696,391; filed Jan. 30, 1985, now U.S. Pat. No. 4,557,415.

BACKGROUND OF THE INVENTION

1. Field of the Invention:

This invention relates generally to folding cartons, and primarily to a flat bottom, open top, paperboard carton with rounded corners which is particularly suitable for use in the packaging of ice cream or related products.

2. Description of the Prior Art:

A prior art search in the U.S. Patent and Trademark Office directed to the subject matter of this application disclosed the following U.S. Patents: Nos. 3,269,640; 3,381,877; 3,602,108; 3,633,814; 3,743,169; 3,918,629; 3,931,385; 4,020,988.

None of the prior art patents uncovered in the search disclosed a one-piece paperboard carton having an absolutely flat bottom with flat side walls, flat end walls, rounded corners, and liquid-tight bottom corner construction.

SUMMARY OF THE INVENTION

It is common to package ice cream in half-gallon quantities in rectilinear cartons, with the more expensive ice cream being packaged in round cartons.

Various round and semi-round cartons have been formed from flat paperboard blanks, but Applicant is unaware of any liquid-tight carton formed from a single blank of foldable paperboard which has a completely flat bottom throughout its entire surface and which has flat side and end walls joined to each other by rounded corners.

It is therefore a primary object of this invention to provided a one-piece, flat bottom, liquid-tight, open-top carton having flat side end walls joined to each other by rounded corners.

A more specific object of the invention is the provision of a novel gusset arrangement for joining the bottom wall panel of a carton to the end and side wall panels to form rounded corners for the carton with a liquid-tight bottom corner construction.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 6:
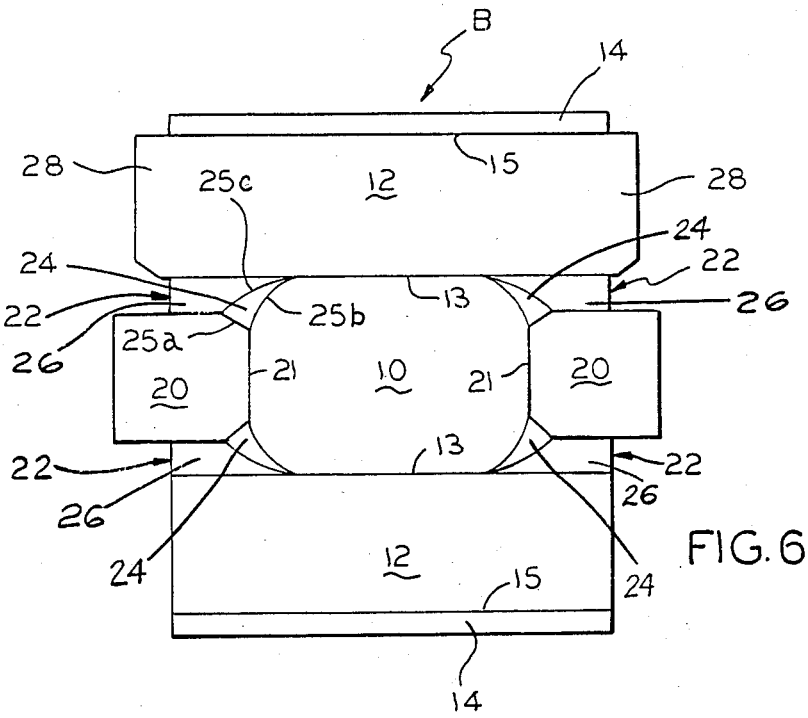
FIG. 6 is a plan view of a blank of foldable sheet material which the carton illustrated in the previous views may formed.

Referring now to the drawings for a better understanding of the invention, it will be seen that the novel open top carton C illustrated in FIGS. 1–5 may be formed from a unitary blank B of foldable sheet material, such as coated paperboard, illustrated in FIG. 6 of the drawings.

Carton C includes a flat bottom wall panel 10 having pairs of opposed straight parallel side and end edges which are interconnected by rounded corner edges.

The carton includes a pair of opposed side wall panels 12 having center portions which are foldably joined along fold lines 13 to opposite side edges of bottom wall panel 10 and which extend upwardly therefrom. Foldably connected to the upper edges of each of the side wall panels 12 along fold lines 15 are a pair of relatively narrow, elongated strips 14 which are folded over and secured to the outer faces of side wall panel 12 to provide flanges for engagement with a lid L, illustrated in FIG. 1, which is separate and apart from the invention of the carton disclosed in this application.

At each end of the carton there is provided an inner end panel 20 which is foldably joined at its lower edge on fold line 21 to an adjacent end edge of bottom wall panel 10.

At each corner of the carton there is provided a gusset 22 which serves to connect the related inner end panel 20 to the bottom wall 10 and also to the adjacent end portion of related side wall panel 12.

Each of the gussets 22 include a generally triangular first gusset section 24 which is actually an extension of the lower corner of the inner end panel 20. If desired it may be joined to the inner end panel 20 by a fold line **25*a* which extends upwardly and outwardly from the adjacent end edge of bottom wall panel 10**.

First gusset section 24 is foldably joined to the adjacent rounded corner edge of bottom wall panel 10 along a rounded fold line **25*b***.

Gusset 22 includes a second and larger gusset section 26, which is generally trapezoidal in shape with its longer side edge being foldably joined to the lower edge of the related end portion of adjacent side wall panel 12 along a fold line which is actually an extension of the fold line 13 which joins the side wall panel to the bottom wall panel. The parallel short side edge of the gusset section 26 is free from attachment to the related inner end panel 20.

An essential feature of this invention which enables the carton to have rounded corners and a flat bottom wall is the fold line **25*c* which connects the first and second gussets sections 24 and 26 to each other. This fold line 25***c* is preferably curved, although it is possible for it to be straight. The primary distinction of the fold line 25*c* is that it extends from the junction of the related side and corner edges of bottom wall panel 10 and is tangent to the curved corner edge of the bottom wall panel.

In order to erect the carton, the inner end panel 20 is folded upwardly at right angles to the bottom wall panel 10 and the end portions of the side wall panels 12 are folded around at 90 degree angles to the center portions of the side walls so as to overlap each other on the outside of the inner end panel 20 where they are adhesively secured to each other and to the inner end panel 20. As this is done the gusset sections of each gusset are folded in face-to-face relation with each other between the lower portion of the related inner end panel 20 and the side wall end portion.

Figure 1:
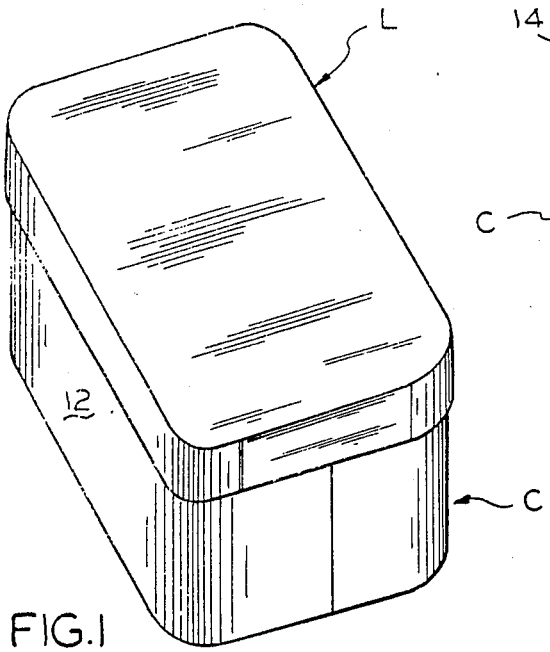
FIG. 1 is a perspective view of a carton embodying features of the invention, shown with a lid which is the subject of a separate application.
Figure 5:
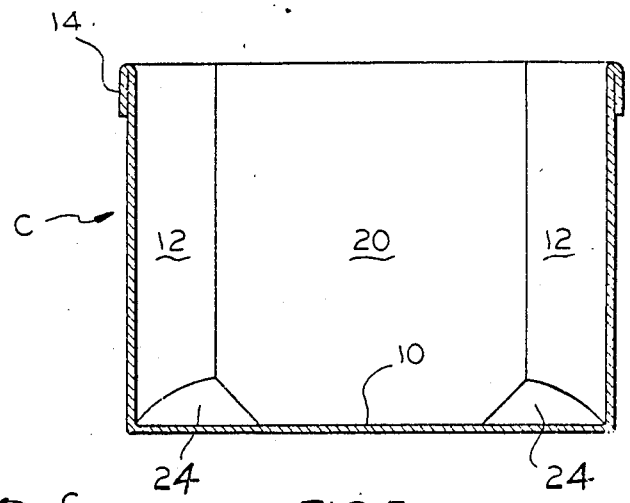
FIG. 5 is a fragmentary transverse vertical sectional view taken on line 5—5 of FIG. 2.

One of the side wall panel end sections is provided with an extension 28, which extends beyond the flange 14 and gusset second section 26, so that when it is secured to the end portion of the other side panel, it can be sandwiched between the the other side wall panel and its gusset second section. Thus, the flanges 14 of the adjacent side wall panel end portions will be in abutting relationship with each other and in a common plane to provide a smooth end wall for the carton which is well adapted to receive a lid L, as shown in FIG. 1.

Thus, the invention is able to provide an attractive rectilinear type carton with flat side and end walls joined to each other along rounded corners and still have a leak-proof bottom corner construction with an absolutely flat bottom wall.

Referring now to the remaining figures of the drawings it will be seen that slightly modified forms of the invention are disclosed. In each of these views the parts of the structures corresponding to previously described structure have been identified by similar numerals.

Figure 7:
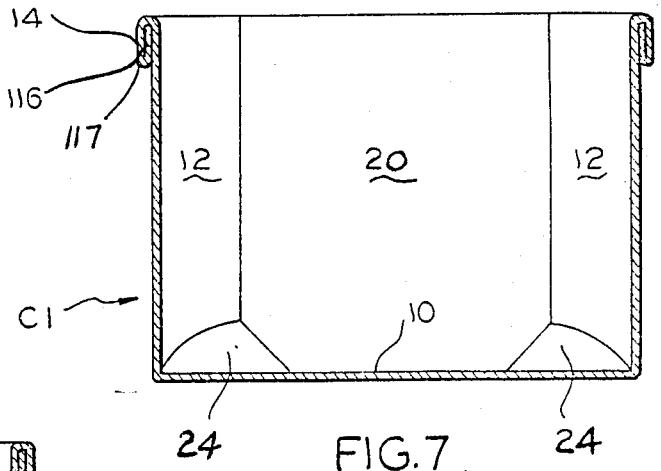
FIG. 7 is a view similar to that of FIG. 5, but illustrating a slightly modified form of the invention.
Figure 8:
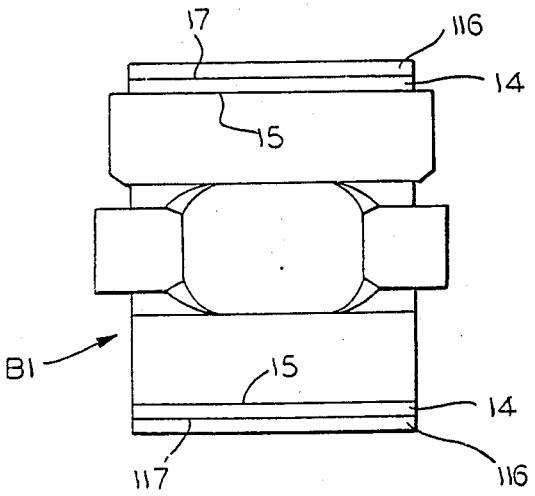
FIG. 8 is a plan view of a blank of foldable sheet material from which the carton illustrated in FIG. 7 may be formed.

FIGS. 7 and 8 present a structure similar to that of the previously described embodiment except that an additional strip or flange element 116 is provided which is foldably joined to panel 12 on the fold line 117 to provide a double thickness flange. In all other respects modification is similar to that of the previously described embodiment.

Figure 9:
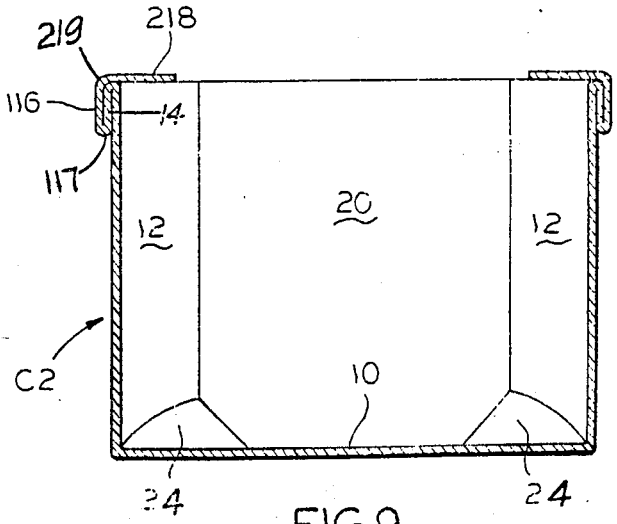
FIG. 9 is a view similar to FIGS. 5 and 7, but illustrating another modification of the invention.
Figure 3:
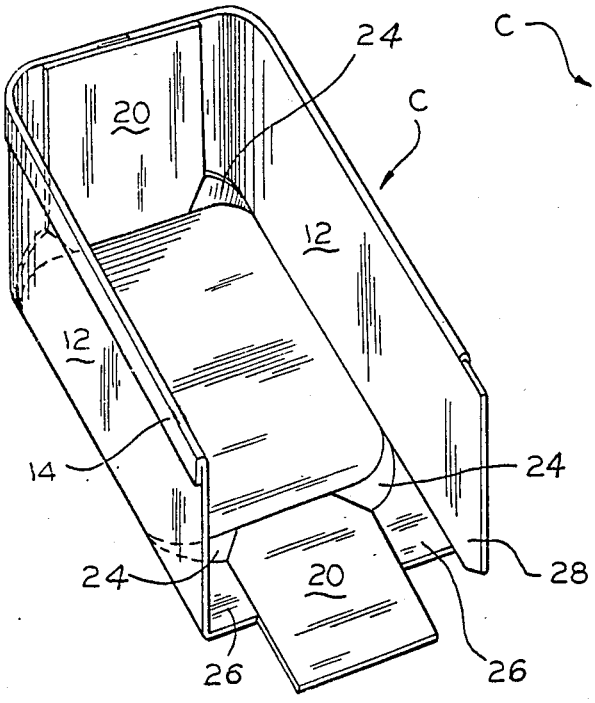
FIGS. 3 and 4 are views similar to FIG. 2, but illustrate various steps in the formation of the carton.
Figure 4:
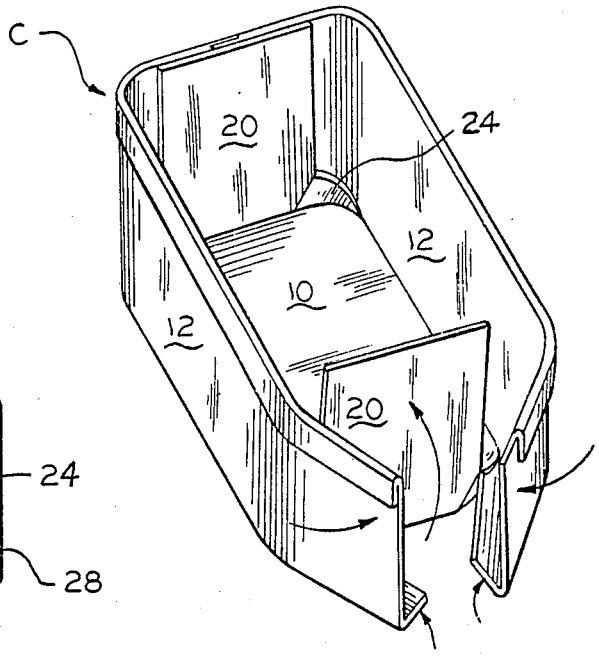
Figure 2:
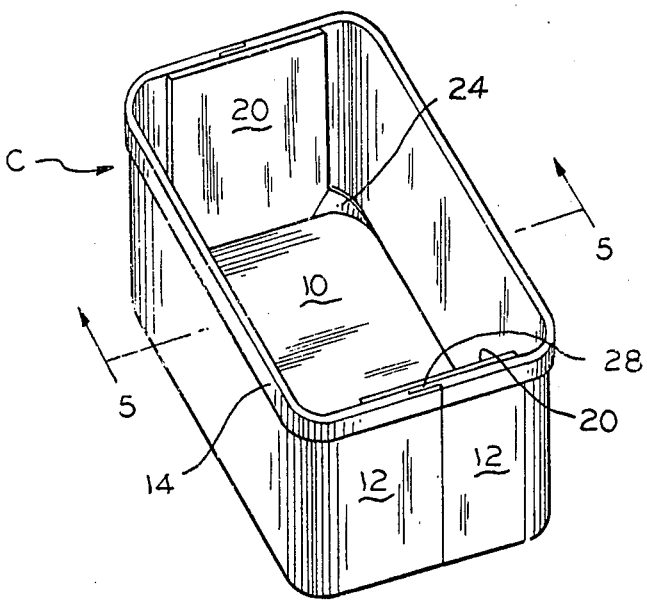
FIG. 2 is a perspective view of the carton illustrated in FIG. 1, but shown without a lid.
Figure 10:
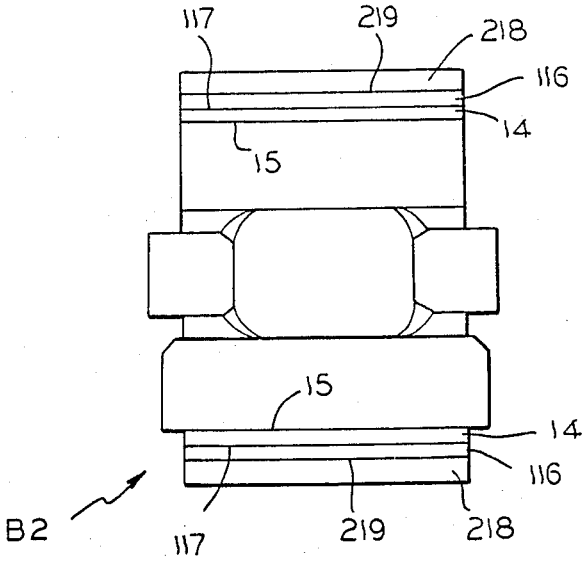
FIG. 10 is a plan view of a blank of foldable sheet material from which the carton illustrated in FIG. 9 may be formed.

FIGS. 9 and 10 disclose yet a slightly modified form of the invention where, in addition to providing a first flange element 14 and a second flange element 116, there is foldably joined to the upper edge of the second flange element 116 along a fold line 219 a dust flap 218 adapted to be folded inwardly at right angles to the side walls to protect the contents of the carton and facilitate placing of the lid on the carton.

Figure 11:
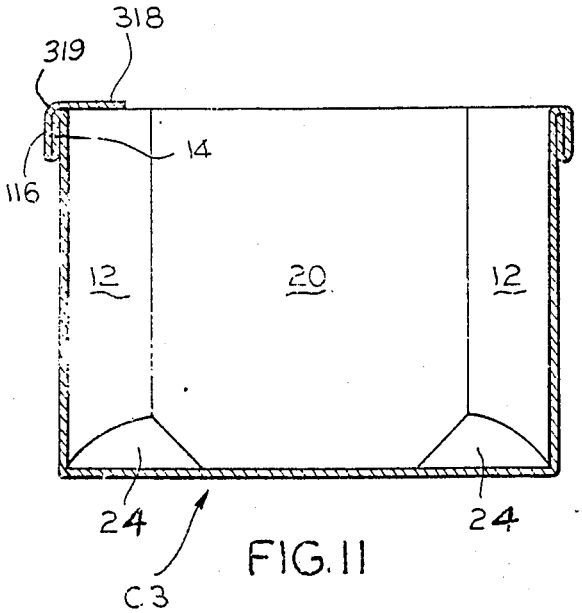
FIG. 11 is a view similar to FIGS. 5, 7 and 9, illustrating yet another modification of the invention.

FIG. 11 shows another modification wherein instead of providing a pair of dust flaps, only one dust flap 318 is provided at the upper edge of the carton and foldably joined on a line 319 to the upper edge of the second flange strip 116.

Figure 12:
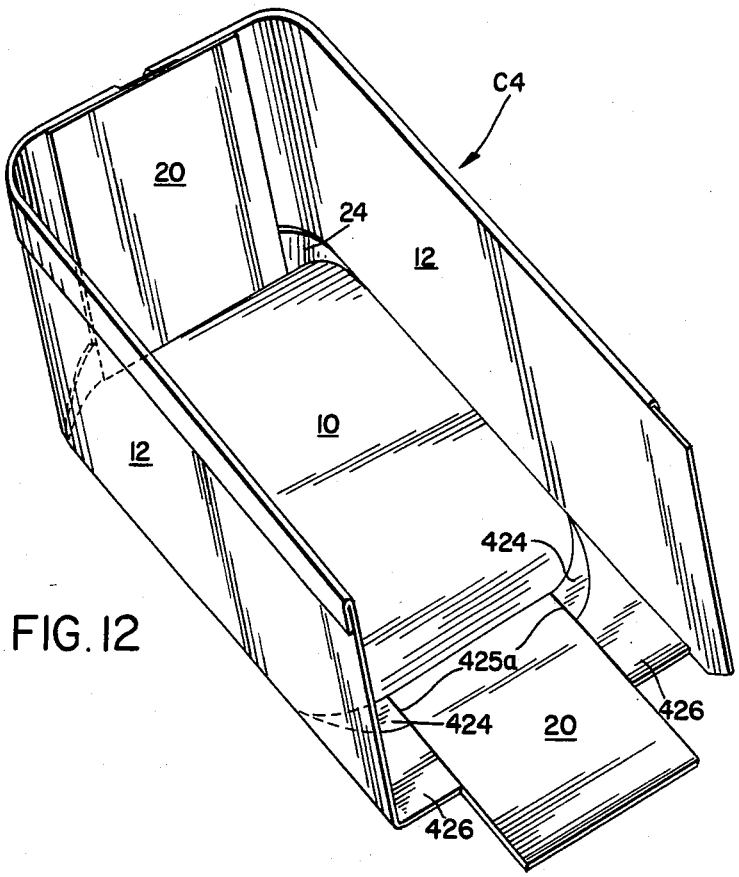
FIGS. 12 and 13 are views similar to those of FIGS. 3 and 6, respectively, but illustrate another modification of the invention.
Figure 13:
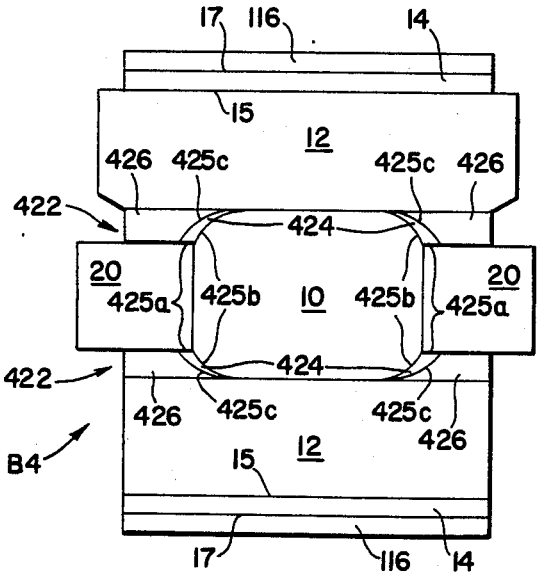

FIGS. 12 and 13 disclose another modification of the invention. In this embodiment the construction is similar to the previously described embodiment illustrated in FIGS. 1–6, except that first section 424 of gusset 422 is defined by fold lines 425*b* and 425*c* and by a cut line 425*a* which is an extension of the cut line separating inner end panel 20 from second section 426 of gusset 422.

Figure 14:
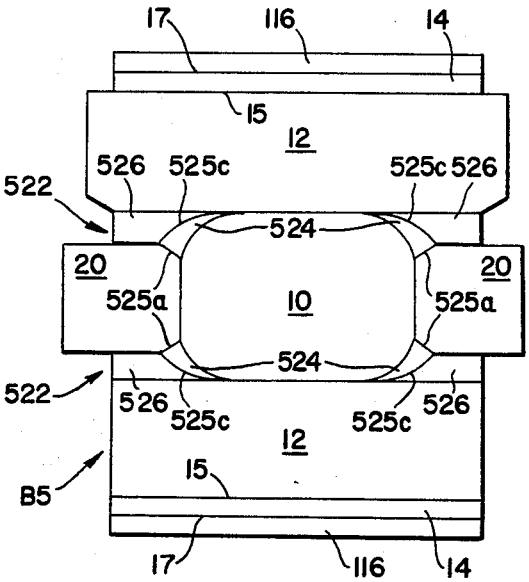
FIG. 14 is a view similar to that of FIG. 13, but illustrating yet another modification of the invention.

FIG. 14 discloses yet another modification of the invention. In this embodiment the construction is similar to the previously described embodiment illustrated in FIGS. 1–6, except that first section 524 of gusset 522 is defined by fold lines 525*b* and 525*c* and by a cut line 525*a* which is in the same location as fold line 25*a* of FIG. 6.

Thus, it will be appreciated, that all of the embodiments of the invention provide a one-piece flat bottom open top carton having straight side and end walls joined to each other by rounded corner walls and which presents a liquid-tight bottom corner construction for the package of liquid or semi-liquid type items such as ice cream.

What is claimed is:

1. An open top, liquid tight carton having a flat bottom wall and having flat side and end walls joined to each other by rounded corners, said carton being formed from a unitary blank of foldable sheet material such as coated paperboard and comprising:

(a) a bottom wall panel having pairs of opposed, parallel, straight side and end edges joined by generally rounded corner edges;

(b) a pair of opposed end wall inner panels foldably joined to and upstanding from opposite end edges of said bottom wall panel;

(c) a pair of opposed side wall panels having center portions foldably joined at lower edges to respective side edges of said bottom wall panel and extending upwardly therefrom to form side walls;

(d) said side wall panels having end portions extending beyond said center portions, over said bottom wall panel corner and end edges, into overlapping relation with each other, outwardly adjacent said end wall inner panels, to form end walls;

(e) a pair of gussets at each end of said carton joining said bottom wall panel to a related end wall inner panel and to said side wall panel end portions to provide a liquid tight bottom corner construction;

(f) each of said gussets including:

(i) a generally triangular first section being foldably joined to said bottom wall panel along a related corner edge of said bottom wall panel;

(ii) a second gusset section foldably joined to a related side wall panel end portion on a fold line which is an extension of a fold line joining said side wall panel center portion to said bottom wall panel and being free from attachment to the related end wall inner panel;

(iii) said gusset sections being foldably joined to each other on a fold line which extends inwardly and upwardly from said bottom wall panel corner edge and is tangent thereto.

2. A carton according to claim 1, wherein said first gusset section is free from direct attachment to said end wall inner end panel.

3. A blank, according to claim 1, wherein said gusset first section is foldably joined to an adjacent edge of said end wall inner panel on a fold line which forms an obtuse angle with a related side edge of said end wall inner panel.

4. A carton blank according to claim 1, wherein said gusset first section is separated from an adjacent edge of said end wall inner panel by a cut line that is aligned with a related side edge of said end wall inner panel.

5. A carton blank according to claim 1, wherein said gusset first section is separated from an adjacent edge of said end wall inner panel by a cut line that forms an obtuse angle with a related side edge of said end wall inner panel.

* * * * *